US009484644B2

(12) United States Patent
Ohkubo et al.

(10) Patent No.: US 9,484,644 B2
(45) Date of Patent: Nov. 1, 2016

(54) TERMINAL STRUCTURE

(71) Applicant: Yazaki Corporation, Tokyo (JP)

(72) Inventors: Yoshitaka Ohkubo, Kakegawa (JP); Shuhei Ando, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/897,776

(22) PCT Filed: Jun. 11, 2014

(86) PCT No.: PCT/JP2014/065515

§ 371 (c)(1),
(2) Date: Dec. 11, 2015

(87) PCT Pub. No.: WO2014/200039

PCT Pub. Date: Dec. 18, 2014

(65) Prior Publication Data

US 2016/0134030 A1 May 12, 2016

(30) Foreign Application Priority Data

Jun. 14, 2013 (JP) ..... 2013-125823

(51) Int. Cl.
*H01R 4/48* (2006.01)
*H01R 13/04* (2006.01)
(Continued)

(52) U.S. Cl.
CPC ..... *H01R 4/4818* (2013.01); *H01R 4/18* (2013.01); *H01R 13/04* (2013.01); *H01R 13/187* (2013.01); *H01R 13/20* (2013.01)

(58) Field of Classification Search
CPC ..... H01R 13/18; H01R 13/20
USPC ..... 439/748, 851, 843, 846, 848, 889, 845
See application file for complete search history.

(56) References Cited

U.S. PATENT DOCUMENTS 4,657,335 A 4/1987 Koch et al.
4,734,063 A 3/1988 Koch et al.
(Continued)

FOREIGN PATENT DOCUMENTS

JP 1-150379 U 10/1989
JP 5-87837 U 11/1993
JP 2000-91013 A 3/2000

OTHER PUBLICATIONS

Search Report dated Sep. 2, 2014 issued by the International Searching Authority in counterpart International Patent Application No. PCT/JP2014/065515 (PCT/ISA/210).
(Continued)

*Primary Examiner* — Tulsidas C Patel
*Assistant Examiner* — Marcus Harcum
(74) *Attorney, Agent, or Firm* — Sughrue Mion, PLLC

(57) ABSTRACT

Provided are a male terminal main body (15) of a male terminal (11), an uneven portion (17) formed, on an outer peripheral surface of the male terminal main body (15), of a plurality of ridges (19) and a plurality of grooves (21), a tubular female terminal main body (23) of the female terminal (13), and a spring contact (37) housed in the female terminal main body (23) in such a manner that a plurality of leaf spring pieces (39) provided corresponding to the ridges (19) are moved from positions facing the grooves (21) to positions facing the ridges (19) by a relative movement of the male terminal main body (15) and are in elastic contact with the ridges (19).

3 Claims, 12 Drawing Sheets

(51) Int. Cl.

| | |
|---|---|
| ***H01R 13/187*** | (2006.01) |
| ***H01R 13/20*** | (2006.01) |
| ***H01R 4/18*** | (2006.01) |

(56) References Cited

U.S. PATENT DOCUMENTS

| | | | | |
|---|---|---|---|---|
| 5,474,479 | A * | 12/1995 | Bennett | H01R 13/187 439/843 |
| 5,487,686 | A * | 1/1996 | Sawada | H01R 13/04 439/692 |
| 5,533,914 | A * | 7/1996 | Sawada | H01R 13/187 439/843 |
| 6,254,439 | B1 | 7/2001 | Endo et al. | |
| 6,616,488 | B1 * | 9/2003 | Tsukishima | H01R 4/10 439/692 |
| 7,156,696 | B1 * | 1/2007 | Montena | H01R 9/05 174/59 |
| 7,252,559 | B1 * | 8/2007 | Morello | H01R 4/185 439/843 |
| 8,272,901 | B2 * | 9/2012 | Rossman | H01R 4/183 439/660 |
| 9,293,850 | B2 * | 3/2016 | Gilliam | H01R 13/04 |
| 2008/0293287 | A1 * | 11/2008 | Zinn | H01R 13/113 439/370 |
| 2016/0134048 | A1 * | 5/2016 | Kato | H01R 13/625 439/587 |

OTHER PUBLICATIONS

Written Opinion dated Sep. 2, 2014 issued by the International Searching Authority in counterpart International Patent Application No. PCT/JP2014/065515 (PCT/ISA/237).

Translation of Written Opinion dated Sep. 2, 2014 issued by the International Searching Authority in counterpart International Patent Application No. PCT/JP2014/065515 (PCT/ISA/237).

* cited by examiner

-PRIOR ART-

TERMINAL STRUCTURE

TECHNICAL FIELD

The present invention relates to a terminal structure.

BACKGROUND ART

As a conventional terminal structure for large current, for example, an electric socket (female terminal) is known in which a tubular terminal (spring contact) is enclosed in a main case (female terminal main body) (see Patent Document 1).

As shown in FIG. 12A, in this type of terminal structure, a spring (spring contact) 503 enclosed in a female terminal 501 is designed so as to have, at a contracted portion 507, an innermost diameter smaller than the outer diameter of a counterpart male terminal 505.

As shown in FIGS. 12B and 12C, in the female terminal 501, when the male terminal 505 is inserted, the contracted portion 507 of the spring 503 is deformed in the diameter increasing direction.

As shown in FIG. 12C, according to this terminal structure, by the elastic deformation of the spring 503 caused when the male terminal is inserted, a contact load is obtained to thereby secure an electrically stable contact.

CITATION LIST

Patent Document

Patent Document 1: U.S. Pat. No. 4,734,063 A

SUMMARY OF THE INVENTION

Technical Problem

However, in the above-described conventional terminal structure, as shown in FIGS. 12C and 12D, it is necessary to insert the male terminal 505 all the way to the insertable depth of the female terminal 501 while receiving the contact load of the spring 503. For this reason, the spring load at the contracted portion 507 becomes the friction resistance, so that the insertion force of the male terminal 505 increases. Moreover, in this case, a contact portion 509 at the contracted portion 507 and a male side slide contact portion 511 along the insertion direction on the outer surface of the male terminal become worn at the same time. And there is a problem in that if it is attempted to increase the contact load to secure a more stable electric contact, the force of insertion of the male terminal 505 into the female terminal 501 becomes higher.

The present invention is made in view of the above-described circumstances, and an object thereof is to provide a terminal structure capable of reducing the terminal insertion force.

Solution to Problem

The above-mentioned object of the present invention is attained by the following structures:

(1) A terminal structure provided with: a male terminal main body of a male terminal; an uneven portion formed, on an outer peripheral surface of the male terminal main body, of a plurality of ridges and a plurality of grooves extending in a terminal insertion direction; a tubular female terminal main body of the female terminal; and a spring contact housed in the female terminal main body in such a manner that a plurality of leaf spring pieces provided corresponding to the ridges are moved from positions facing the grooves to positions facing the ridges by a relative movement by a movement of at least either one of the male terminal main body and the female terminal main body and are in elastic contact with the ridges.

According to the terminal structure of the structure of the above (1), the male terminal is inserted in the female terminal main body in a position where the ridges of the male terminal main body are not in contact with the leaf spring pieces of the spring contact. Therefore, the friction resistance due to the spring load does not occur on the male terminal. Moreover, no friction occurs at the contact portion on the outer peripheral surface of the male terminal or at the male side slide contact portion along the insertion direction.

Then, the male terminal main body inserted in the female terminal main body all the way to the insertable depth is relatively moved with respect to the female terminal main body to a position where the ridges of the uneven portion face the leaf spring pieces of the spring contact. At the time of this movement, the ridges elastically deform the leaf spring pieces by pressing them. The movement of the male terminal is stopped in the position where the ridges of the male terminal main body face the leaf spring pieces of the spring contact, and the engagement and connection with the female terminal are completed.

(2) The terminal structure of the structure of the above (1), wherein the uneven portion is formed by alternately disposing the ridges and the grooves in a circumferential direction of the male terminal main body formed in a cylindrical shape, and the leaf spring pieces are formed at intervals corresponding to the ridges in a circumferential direction of the circular-tube-shaped spring contact housed in the female terminal main body formed in a circular tube shape.

According to the terminal structure of the structure of the above (2), the cylindrical male terminal main body is inserted into the circular-tube-shaped female terminal main body. The uneven portion and the leaf spring pieces are disposed around the insertion center, so that the terminal structure can be made compact. Moreover, regarding the male terminal and the female terminal, after the completion of the insertion, the ridges and the leaf spring pieces can be easily positioned by a rotation operation around the insertion center.

(3) The terminal structure according to the structure of the above (1), wherein the uneven portion is formed by alternately disposing the ridges and the grooves on one surface of the male terminal main body formed in a strip shape, and the leaf spring pieces are formed at intervals corresponding to the ridges in a direction orthogonal to the terminal insertion direction of the spring contact of a rectangular plate form housed in the female terminal main body formed in a quadrangular tube shape.

According to the terminal structure of the structure of the above (3), the male terminal main body of a strip shape is inserted into the female terminal main body of a quadrangular tube shape. The ridges, the grooves and the leaf spring pieces are arranged in the direction of a plane orthogonal to the terminal insertion direction, so that the height of the terminal structure can be reduced. Moreover, regarding the male terminal and the female terminal, after the completion of the insertion, the ridges and the leaf spring pieces can be easily positioned by a slide operation in a direction orthogonal to the terminal insertion direction and along one surface of the male terminal main body.

Advantage of the Invention

According to the terminal structure of the present invention, the terminal insertion force can be reduced.

The present invention has been briefly described above. Further, details of the present invention will be further clarified by reading through the mode for carrying out the invention (hereinafter, referred to as "embodiment") described below with reference to the attached drawings.

DESCRIPTION OF EMBODIMENT

Hereinafter, embodiments according to the present invention will be described with reference to the drawings.

Figure 1:
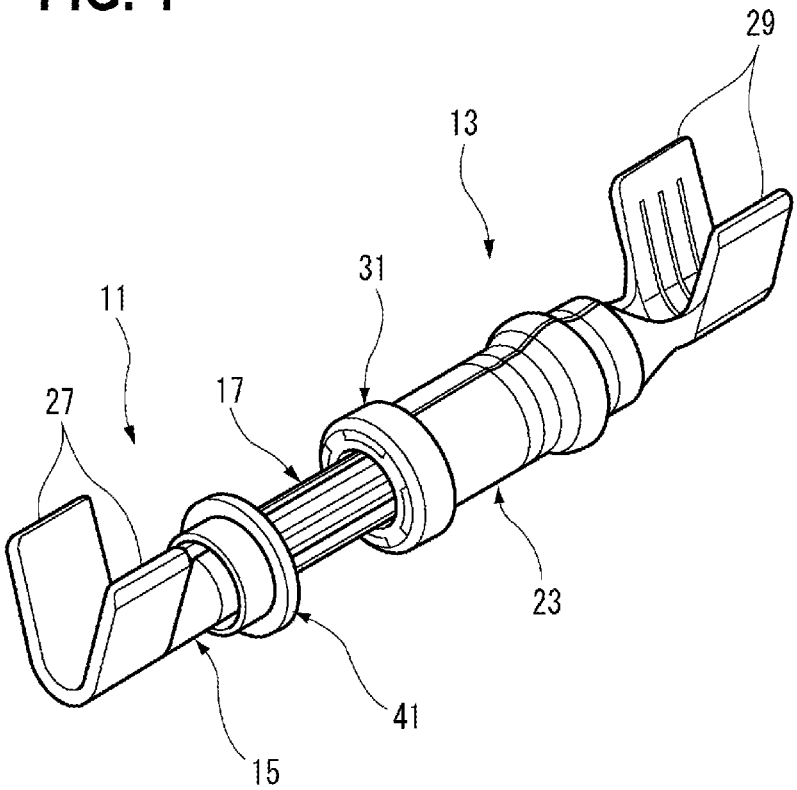
FIG. 1 is a perspective view of a fitting midstream condition of a male terminal and a female terminal provided with a terminal structure according to a first embodiment of the invention.
Figure 2:
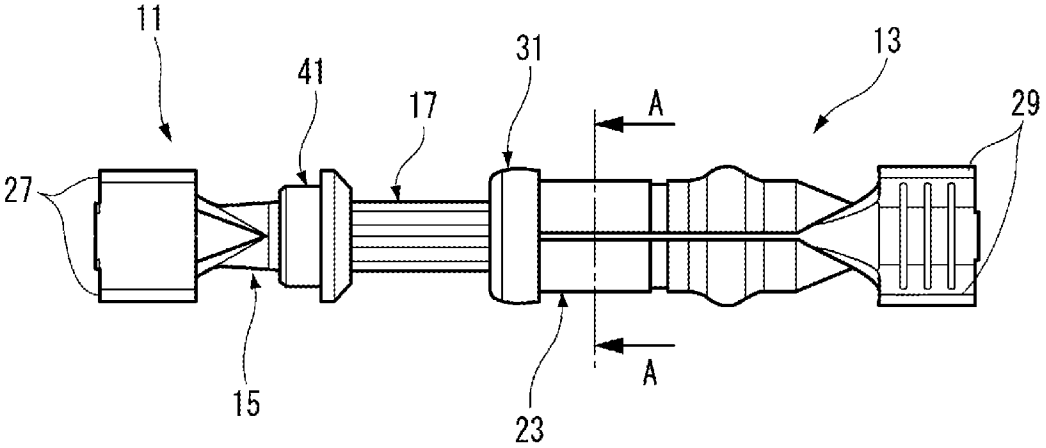
FIG. 2 is a plan view of the male terminal and the female terminal shown in FIG. 1.

A terminal structure according to a first embodiment of the present invention is applied to a male terminal 11 and a female terminal 13 shown in FIG. 1.

Figure 3A:
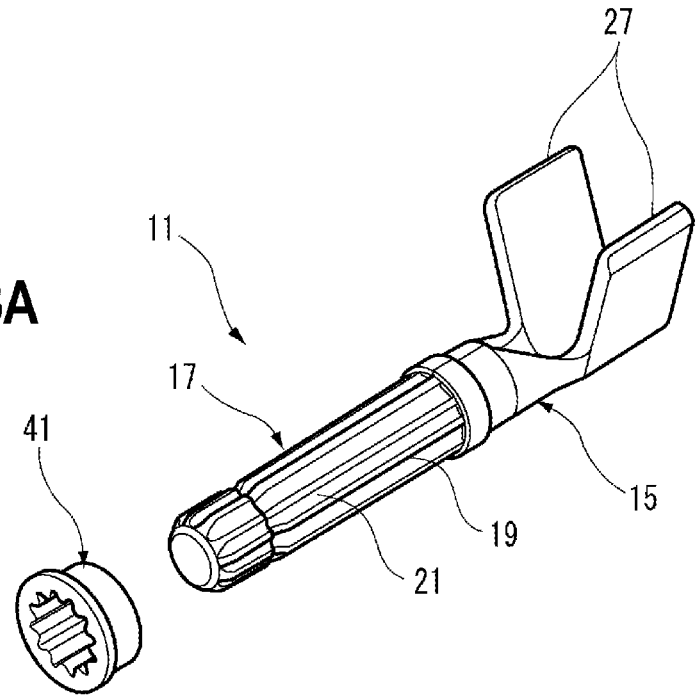
FIG. 3A is an exploded perspective view of the male terminal shown in FIG. 1.
Figure 3B:
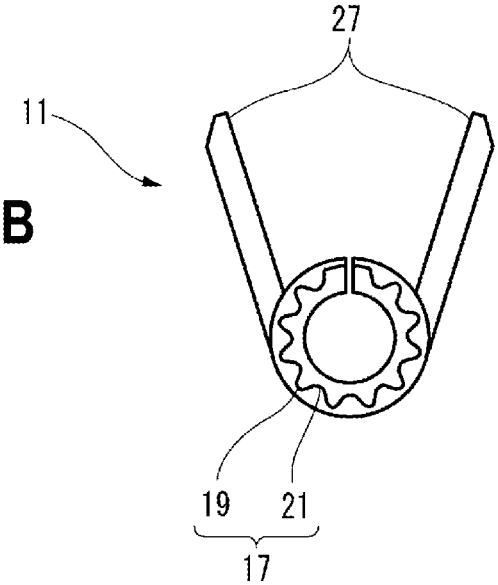
FIG. 3B is a front view of the male terminal shown in FIG. 1.

The male terminal 11 of the present first embodiment has a male terminal main body 15 formed in a cylindrical shape by rounding a conductive metal plate into a circular tube shape. As shown in FIG. 3A, on the outer peripheral surface of the male terminal main body 15, an uneven portion 17 is formed of a plurality of ridges 19 and a plurality of grooves 21 extending in the terminal insertion direction. The uneven portion 17 is formed by alternately disposing the ridges 19 and the grooves 21 in the circumferential direction of the male terminal main body 15 formed in a cylindrical shape.

On the rear end side in the insertion direction of the male terminal main body 15, a pair of swaging pieces 27, 27 crimped to an electric wire conductor (not shown) are consecutively provided in an opened state. The swaging pieces 27 are swaged to the electric wire conductor. In the present description, the terminals will be described with the insertion side as the "front" and the opposite side as the "rear".

Figure 4A:
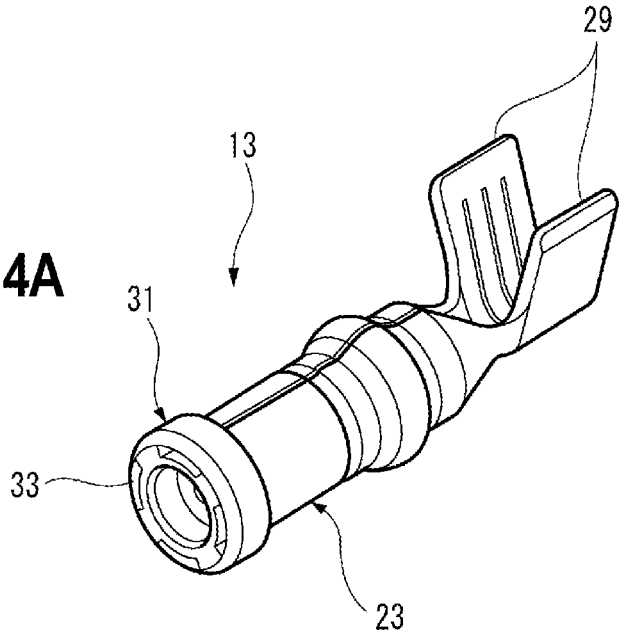
FIG. 4A is a perspective view of the female terminal shown in FIG. 1.
Figure 4B:
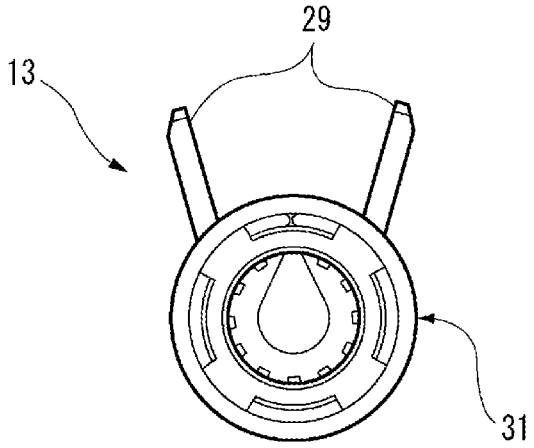
FIG. 4B is a front view of the female terminal shown in FIG. 4A.

The female terminal 13 of the present first embodiment has, as shown in FIGS. 4A and 4B, a female terminal main body 23 formed in a circular tube shape by rounding a conductive metal plate into a circular tube shape.

On the rear end side in the insertion direction of the female terminal main body 23, a pair of swaging pieces 29, 29 crimped to an electric wire conductor are consecutively provided in an opened state. The swaging pieces 29, 29 are swaged to the electric wire conductor.

Figure 5:
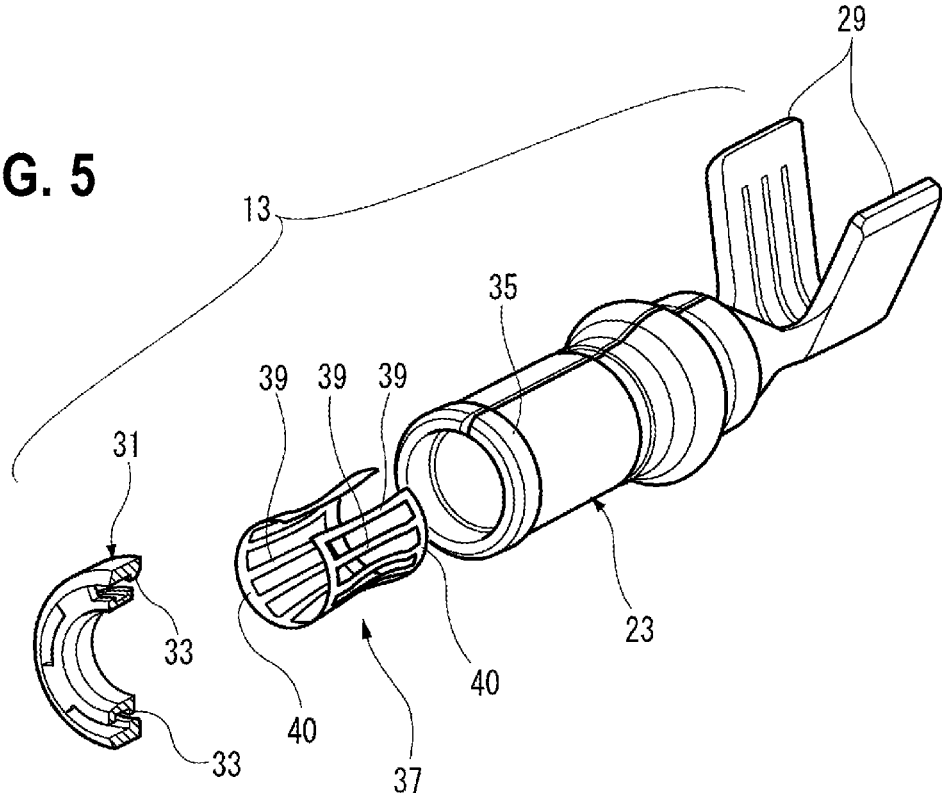
FIG. 5 is an exploded perspective view of the female terminal shown in FIG. 4.

In the female terminal main body 23, as shown in FIG. 5, a circular-tube-shaped spring contact 37 is housed. The spring contact 37 is formed by punching from a square metal (for example, phosphor bronze) plate having conductivity and spring property into a shape where a multiplicity of curved leaf spring pieces 39 are joined by joining portions 40, 40, and rounding this into a circular tube shape. The plurality of leaf spring pieces 39 are formed at intervals corresponding to the ridges 19 in the circumferential direction with a spring width narrower than the groove width of the grooves 21.

The spring contact 37 formed in this way is inserted into the female terminal main body 23, and then, held in the female terminal main body 23 by a cap 31 being attached to the front end of the female terminal main body 23. The cap 31 made of resin is fixed to the front end of the female terminal main body 23 by an engagement claw 33 (see FIG. 5) being engaged with a ring-shaped engagement convex portion 35 (see FIG. 5) provided so as to protrude on the outer periphery of the front end of the female terminal main body 23.

The leaf spring pieces 39 of the spring contact 37 housed in the female terminal main body 23 are relatively moved from positions facing the grooves 21 having a groove width wider than the spring width to positions facing the ridges 19 by a relative rotation by a rotation of at least either one of the male terminal main body 15 and the female terminal main body 23, and are in elastic contact with the ridges 19.

Next, the workings of the terminal structure according to the above-described first embodiment will be described.

Figure 6B:
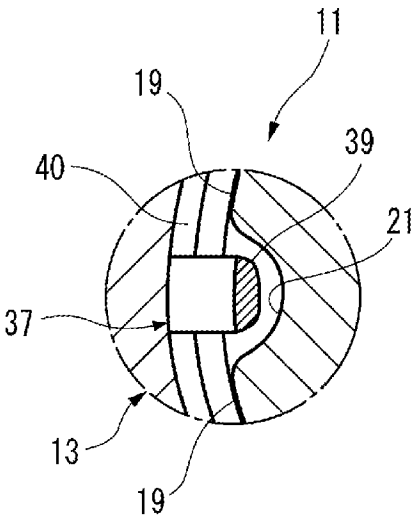
FIG. 6B is an enlarged view of the A portion in FIG. 6A.
Figure 6A:
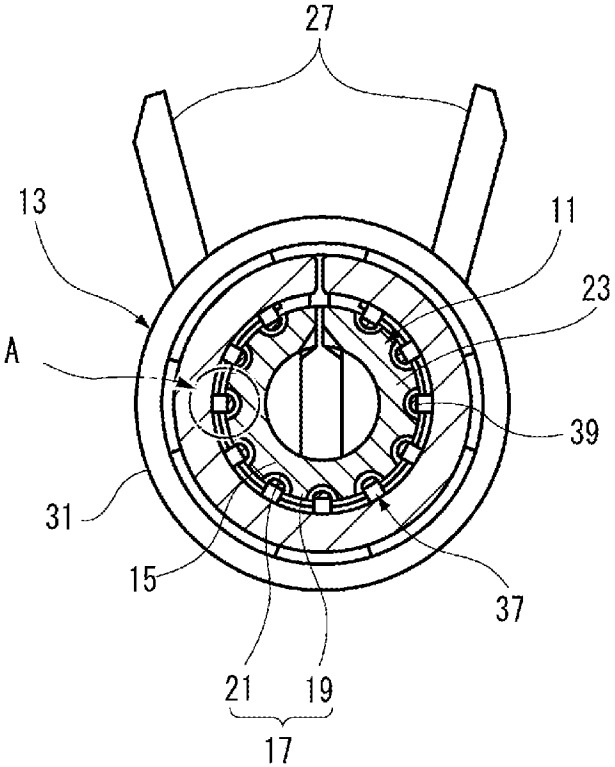
FIG. 6A is a cross-sectional view of the A-A position of FIG. 2 before the completion of the terminal connection.

According to the terminal structure of the above-described first embodiment, as shown in FIGS. 6A and 6B, the male terminal 11 is inserted in the female terminal main body 23 in a position where the ridges 19 of the male terminal main body 15 are not in contact with the leaf spring pieces 39 of the spring contact 37. That is, the insertion of the male terminal 11 is performed while the leaf spring pieces 39 of the spring contact 37 are received in the grooves 21 having a groove width wider than the spring width of the leaf spring pieces 39, respectively. Therefore, the friction resistance due to the spring load does not occur when the male terminal 11 is inserted. Moreover, no friction occurs at the contact portion on the outer peripheral surface of the male terminal 11 or at the male side slide contact portion along the insertion direction.

In this way, the male terminal 11 causing hardly any friction resistance with the female terminal main body 23 is inserted with a low insertion force compared with the conventional structure.

Figure 7B:
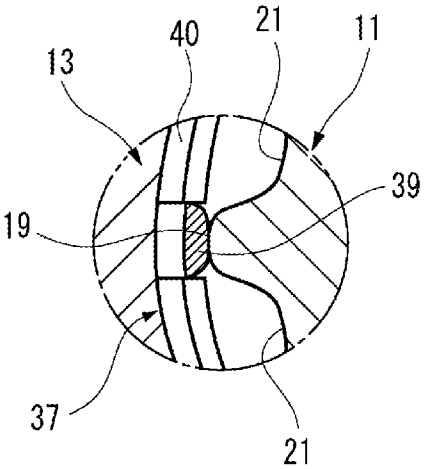
FIG. 7B is an enlarged view of the B portion in FIG. 7A.
Figure 7A:
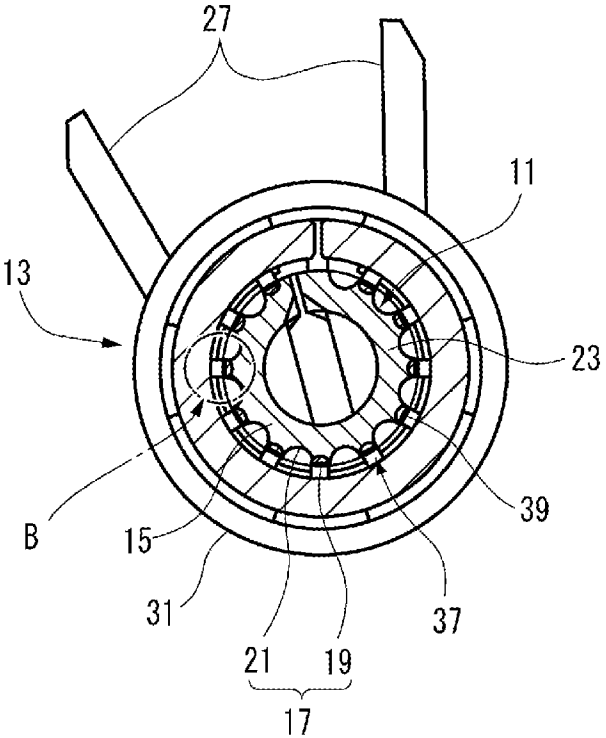
FIG. 7A is a cross-sectional view of the A-A position of FIG. 2 after the completion of the terminal connection.

Then, the male terminal 11 inserted in the female terminal main body 23 all the way to the insertable depth is, as shown in FIGS. 7A and 7B, relatively moved (relatively rotated) with respect to the female terminal main body 23 to a position where the ridges 19 of the uneven portion 17 face the leaf spring pieces 39 of the spring contact 37. At the time of this movement, the ridges 19 elastically deform the leaf spring pieces 39 by pressing them outward in the radial direction.

The movement of the male terminal 11 is stopped in the position where the ridges 19 of the male terminal main body 15 face the leaf spring pieces 39 of the spring contact 37, and the engagement and connection with the female terminal 13 are completed.

With the ridges 19 of the male terminal main body 15, the leaf spring pieces 39 of the spring contact 37 are in pressure contact by pressing with an elastic restoring force. The connection operation force of the male terminal 11 is maximum at this time. Although the connection operation force at this time is large, the movement distance is the pitch distance of the ridges 19 and the grooves 21 and small, and is smaller than the distance to the insertable depth of the male terminal 11. For this reason, the insertion operation force is small.

And in the terminal structure according to the present first embodiment, the cylindrical male terminal main body 15 is inserted into the circular-tube-shaped female terminal main body 23. The uneven portion 17 and the leaf spring pieces 39 are disposed around the insertion center, so that the terminal structure can be made compact. Moreover, regarding the male terminal 11 and the female terminal 13, after the completion of the insertion, the ridges 19 and the leaf spring pieces 39 can be easily positioned by a rotation operation around the insertion center.

The male terminal 11 and the female terminal 13 may be provided with a stopper mechanism that restricts the operation range at the time of a rotation operation.

Figure 8:
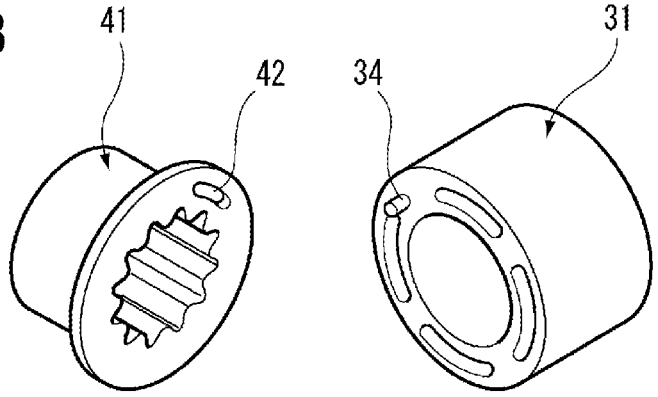
FIG. 8 is a perspective view for explaining a stopper mechanism.

As shown in FIG. 8, the stopper mechanism may be formed of, for example, a cylindrical engagement protrusion 34 provided so as to protrude on the front end surface of the cap 31 attached to the front end of the female terminal main body 23 and an engagement elongated hole 42 provided through a flange member 41 attached to the male terminal main body 15. The engagement protrusion 34 is inserted into the engagement elongated hole 42 at the time of terminal insertion and fitting, and abuts on the end portion of the engagement elongated hole 42 to restrict the rotation with respect to the male terminal 11 in a rotation position where the ridges 19 coincide with the leaf spring pieces 39. In addition, the stopper mechanism may be one provided on a male housing (not shown) housing the male terminal 11 and a female housing (not shown) housing the female terminal 13.

Consequently, according to the terminal structure of the present first embodiment, the terminal insertion force of the male terminal 11 and the female terminal 13 can be reduced.

Next, a terminal structure according to a second embodiment of the present invention will be described.

Figure 9A:
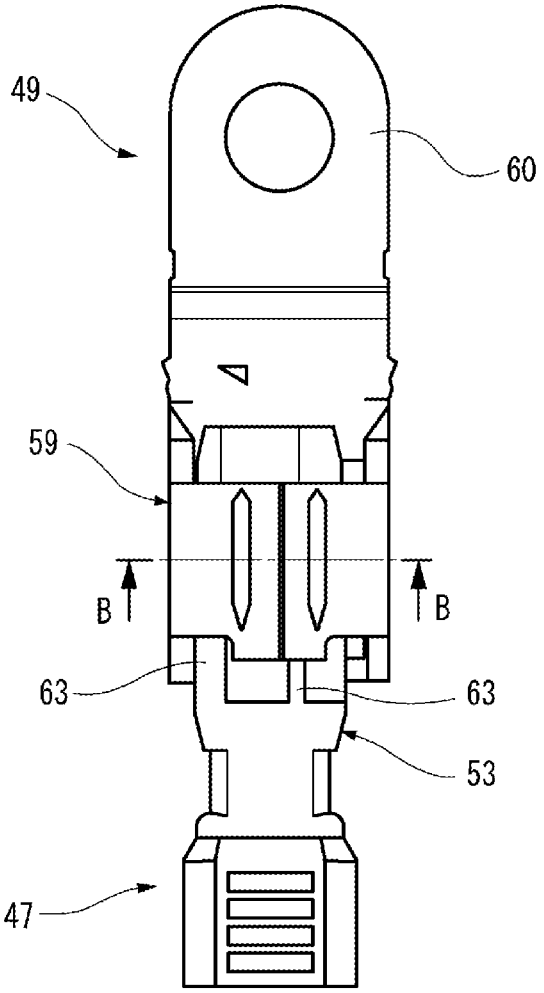
FIG. 9A is a plan view, before the completion of the connection, of the male terminal and the female terminal provided with the terminal structure according to a second embodiment of the present invention.
Figure 9B:
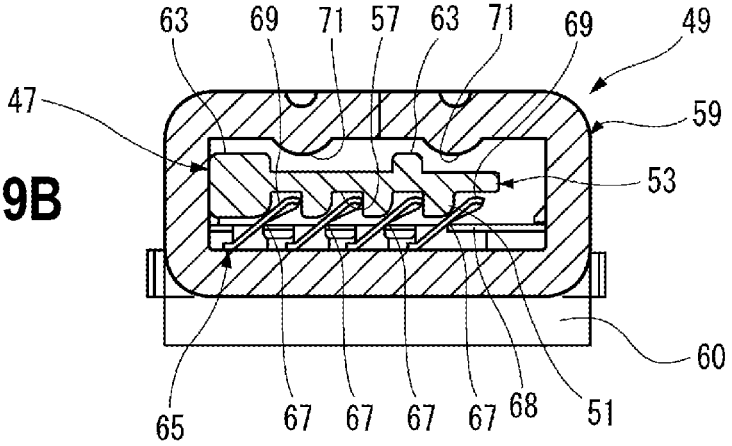
FIG. 9B is a B-B cross-sectional view of FIG. 9A.

The terminal structure according to the second embodiment of the present invention is applied to a male terminal 47 and a female terminal 49 shown in FIGS. 9A and 9B.

Figure 10A:
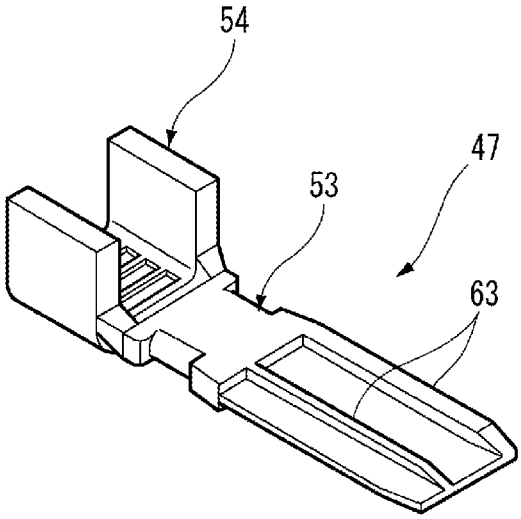
FIG. 10A is a perspective view of the male terminal shown in FIGS. 9A and 9B when viewed from a side opposite to an uneven portion.
Figure 10B:
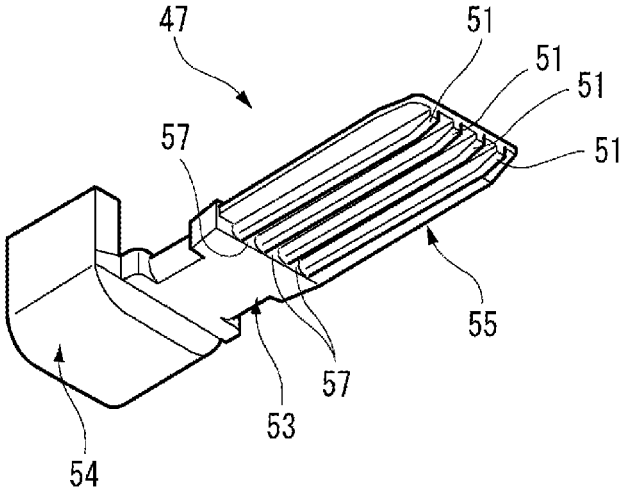
FIG. 10B is a perspective view of the male terminal of FIG. 10A when viewed from the side of the uneven portion.

The male terminal 47 of the present second embodiment has, as shown in FIGS. 10A and 10B, a male terminal main body 53 formed in a strip shape by press-molding a conductive metal plate.

As shown in FIG. 10B, on the lower surface as one surface of the male terminal main body 53, an uneven portion 55 is formed of a plurality of ridges 51 and a plurality of grooves 57 extending in the terminal insertion direction. The uneven portion 55 is formed by alternately disposing the ridges 51 and the grooves 57 in the width direction of the male terminal main body 53 formed in a strip shape.

As shown in FIG. 10A, on the upper surface as the other surface of the male terminal main body 53, a pair of pressing ridges 63 are provided so as to protrude in the terminal insertion direction.

On the rear end side in the insertion direction of the male terminal main body 53, a conductor fixing portion 54 welded to an electric wire conductor (not shown) is consecutively provided. The conductor fixing portion 54 is fixed to the electric wire conductor by welding.

The female terminal 49 of the present second embodiment has, as shown in FIGS. 9A and 9B, a female terminal main body 59 formed in a flat quadrangular tube shape by bending a conductive metal plate into a quadrangular tube shape. The quadrangular-tube-shaped female terminal main body 59 is a flat space where the inside is low in height. The width dimension (the dimension in the horizontal direction of FIG. 9) of the female terminal main body 59 is larger than the width dimension of the male terminal main body 53. This enables the male terminal main body 53 to slide in the width direction inside the female terminal main body 59.

On the rear end side in the insertion direction of the female terminal main body 59, a round fixing portion 60 bolted to the electric wire conductor is consecutively provided. The round fixing portion 60 is fixed to the electric wire conductor by a bolt (not shown) inserted through a through hole.

On the bottom portion inside the female terminal main body 59, as shown in FIG. 9B, a spring contact 65 of a rectangular plate form is housed. The spring contact 65 is formed by punching from a square metal (for example, phosphor bronze) plate having conductivity and spring property into a shape where a multiplicity of leaf spring pieces 67 each having an L-shaped end portion 69 and bent obliquely are joined by joining portions 68. The plurality of leaf spring pieces 67 are formed so as to slant in such a manner as to rise in the slide direction (width direction) of the male terminal main body 53, and the L-shaped end portions 69 are, as shown in FIG. 9B, formed at intervals corresponding to the ridges 51 in the width direction with a bend width narrower than the groove width of the grooves 57. The spring contact 65 formed in this manner is inserted into the female terminal main body 59.

On the ceiling side of the female terminal main body 59, a pair of parallel pressing protrusions 71 are formed corresponding to the pressing ridges 63 of the male terminal main body 53. The pressing protrusions 71 and the pressing ridges 63 coincide when the male terminal 47 is slid in the width direction after the insertion is completed. Regarding the male terminal 47, the ridges 51 are pressed against the leaf spring pieces 67 of the spring contact 65 by the pressing ridges 63 being pressed by the pressing protrusions 71.

The leaf spring pieces 67 of the spring contact 65 inserted in the female terminal main body 59 is relatively moved from positions facing the grooves 57 having a groove width wider than the bend width of the L-shaped end portions 69 to positions facing the ridges 51 by a relative movement by a movement of at least either one of the male terminal main body 53 and the female terminal main body 59, and are in elastic contact with the ridges 51.

Next, the workings of the terminal structure according to the above-described second embodiment will be described.

According to the terminal structure of the above-described second embodiment, as shown in FIGS. 9A and 9B, the male terminal 47 is inserted in the female terminal main body 59 in a position where the ridges 51 of the male terminal main body 53 are not in contact with the leaf spring pieces 67 of the spring contact 65. That is, the insertion of the male terminal 47 is performed while the L-shaped end portions 69 of the leaf spring pieces 67 are received in the grooves 57 having a groove width wider than the bend width of the L-shaped end portions 69, respectively. Therefore, the friction resistance due to the spring load does not occur on the male terminal 47. Moreover, no friction occurs at the contact portion on the outer peripheral surface of the male terminal 47 or at the male side slide contact portion along the insertion direction.

In this way, the male terminal 47 causing hardly any friction resistance with the female terminal main body 59 is inserted with a low insertion force compared with the conventional structure.

Figure 11A:
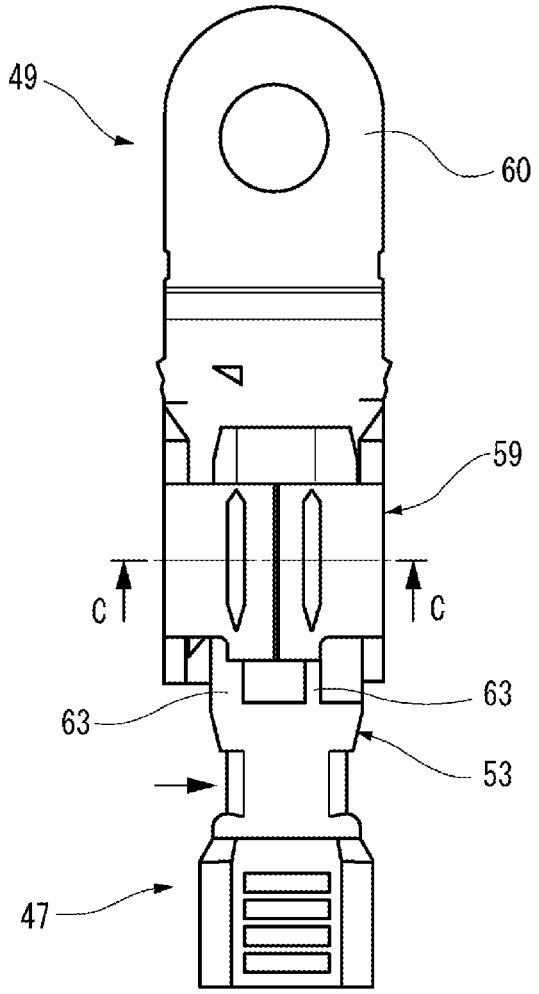
FIG. 11A is a plan view of the male terminal and the female terminal shown in FIGS. 9A and 9B after the completion of the connection.
Figure 11B:
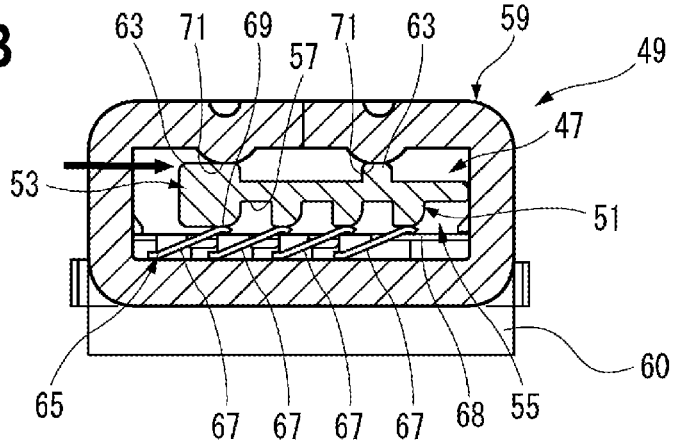
FIG. 11B is a C-C cross-sectional view of FIG. 11A.
Figures 12A, 12B, 12C, 12D:
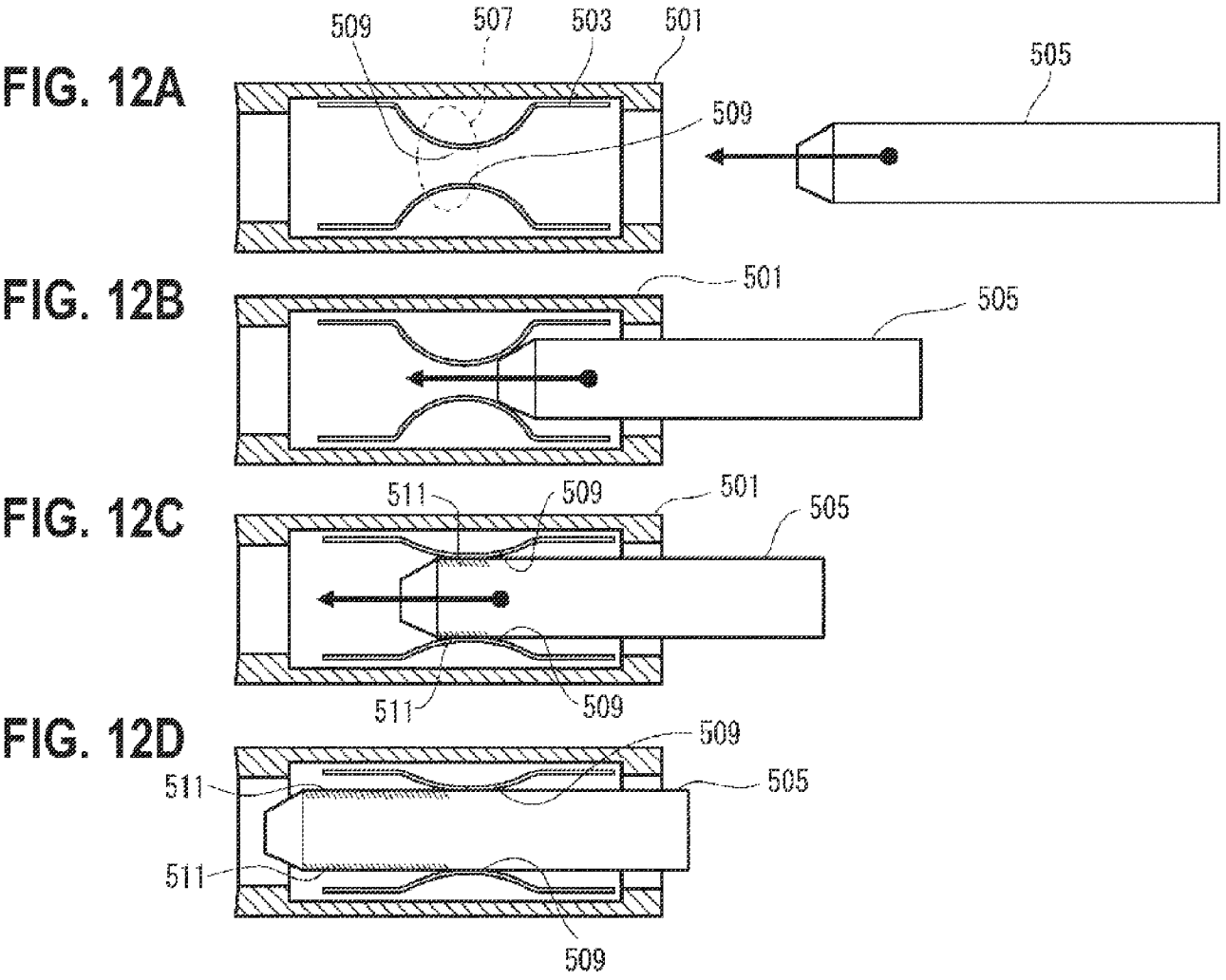
FIGS. 12A to 12D are operation explanatory views showing the process to the completion of insertion of the male terminal and the female terminal in the conventional terminal structure.

Then, the male terminal 47 inserted in the female terminal main body 59 all the way to the insertable depth is, as shown in FIGS. 11A and 11B, relatively moved in the width direction linearly with respect to the female terminal main body 59 to a position where the ridges 51 of the uneven portion 55 face the leaf spring pieces 67 of the spring contact 65. At the time of this movement, the ridges 51 elastically deform the leaf spring pieces 67 by pressing them downward.

The movement of the male terminal 47 is stopped in the position where the ridges 51 of the male terminal main body 53 face the L-shaped end portions 69 of the leaf spring pieces 67 of the spring contact 65, and the engagement and connection with the female terminal 49 are completed.

With the ridges 51 of the male terminal main body 53, the leaf spring pieces 67 of the spring contact 37 are in pressure contact by pressing with an elastic restoring force. The connection operation force of the male terminal 47 is maximum at this time. Although the connection operation force at this time is large, the movement distance is the pitch distance of the ridges 51 and the grooves 57 and small, and is smaller than the distance to the insertable depth of the male terminal 47. For this reason, the insertion operation force is small. Moreover, regarding the male terminal 47, since the ridges 51 are pressed against the leaf spring pieces 67 of the spring contact 65 by the pressing ridges 63 being pressed by the pressing protrusions 71 and the normal force is increased by the elastic repulsion force of the leaf spring pieces 67 to increase the slide resistance (the friction resistance of each sliding portion), the condition of being fitted and connected with the female terminal 49 (see FIGS. 11A and 11B) are maintained.

And in the terminal structure according to the present second embodiment, the male terminal main body 53 of a strip shape is inserted into the female terminal main body 59 of a quadrangular tube shape. The ridges 51, the grooves 57 and the leaf spring pieces 67 are arranged in the direction of a plane orthogonal to the terminal insertion direction, so that the height of the terminal structure can be reduced. Moreover, regarding the male terminal 47 and the female terminal 49, after the completion of the insertion, the ridges 51 and the leaf spring pieces 67 can be easily positioned by a slide operation in a direction orthogonal to the terminal insertion direction and along the lower surface of the male terminal main body 53.

Regarding the female terminal 49, in a movement position where the ridges 51 coincide with the leaf spring pieces 67, a side end of the male terminal main body 53 abuts on the inner wall of the female terminal main body 59, so that the movement with respect to the female terminal 49 can be restricted.

Therefore, according to the terminal structure of the above-described second embodiment, the terminal insertion force of the male terminal 47 and the female terminal 49 can be reduced.

Now, features of the embodiments of the terminal structure according to the above-described present invention are briefly summarized and listed in the following [1] to [3]:

[1] A terminal structure provided with:

a male terminal main body (15) of a male terminal (11);

an uneven portion (17) formed, on an outer peripheral surface of the male terminal main body (15), of a plurality of ridges (19) and a plurality of grooves (21) extending in a terminal insertion direction;

a tubular female terminal main body (23) of the female terminal (13); and a spring contact (37) housed in the female terminal main body (23) in such a manner that a plurality of leaf spring pieces (39) provided corresponding to the ridges (19) are moved from positions facing the grooves (21) to positions facing the ridges (19) by a relative movement by a movement of at least either one of the male terminal main body (15) and the female terminal main body (23) and are in elastic contact with the ridges (19).

[2] The terminal structure according to the above (1), wherein the uneven portion (17) is formed by alternately disposing the ridges (19) and the grooves (21) in a circumferential direction of the male terminal main body (15) formed in a cylindrical shape, and the leaf spring pieces (39) are formed at intervals corresponding to the ridges (19) in a circumferential direction of the circular-tube-shaped spring contact (37) housed in the female terminal main body (23) formed in a circular tube shape.

[3] The terminal structure according to the above (1), wherein the uneven portion (55) is formed by alternately disposing the ridges (51) and the grooves (57) on one surface of the male terminal main body (53) formed in a strip shape, and the leaf spring pieces (67) are formed at intervals corresponding to the ridges (51) in a direction orthogonal to the terminal insertion direction of the spring contact (65) of a rectangular plate form housed in the female terminal main body (59) formed in a quadrangular tube shape.

The present invention is not limited to the above-described embodiments, and modifications, improvements and the like may be made as appropriate. In addition, the material, configuration, dimensions, number, position of disposition and the like of each element in the above-described embodiments are arbitrary as long as the present invention can be attained, and are not limited.

Moreover, the present application is based upon Japanese Patent Application (Patent Application No. 2013-125823) filed on Jun. 14, 2013, the contents of which are incorporated herein by reference.

INDUSTRIAL APPLICABILITY

According to the terminal structure of the present invention, an excellent terminal structure can be provided that is capable of reducing the terminal insertion force while securing an electric contact.

REFERENCE SIGN LIST

11 Male terminal
13 Female terminal
15 Male terminal main body
17 Uneven portion
19 Ridge
21 Groove
23 Female terminal main body
37 Spring contact
39 Leaf spring piece

The invention claimed is:

1. A terminal structure comprising:

a male terminal main body of a male terminal;

an uneven portion formed on an outer peripheral surface of the male terminal main body with a plurality of ridges and a plurality of grooves extending in a terminal insertion direction;

a tubular female terminal main body of the female terminal; and a spring contact housed in the female terminal main body in such a manner that a plurality of leaf spring pieces provided corresponding to the ridges are moved from positions facing the grooves to positions facing the ridges by a relative movement by a movement of at least either one of the male terminal main body and the female terminal main body and are in elastic contact with the ridges.

2. The terminal structure according to claim 1, wherein the uneven portion is formed by alternately disposing the ridges and the grooves in a circumferential direction of the male terminal main body formed in a cylindrical shape, and the leaf spring pieces are formed at intervals corresponding to the ridges in a circumferential direction of the circular-tube-shaped spring contact housed in the female terminal main body formed in a circular tube shape.

3. The terminal structure according to claim 1, wherein the uneven portion is formed by alternately disposing the ridges and the grooves on one surface of the male terminal main body formed in a strip shape, and the leaf spring pieces are formed at intervals corresponding to the ridges in a direction orthogonal to the terminal insertion direction of the spring contact of a rectangular plate form housed in the female terminal main body formed in a quadrangular tube shape.

* * * * *